US006853153B2

(12) United States Patent
Gray

(10) Patent No.: US 6,853,153 B2
(45) Date of Patent: Feb. 8, 2005

(54) SYSTEM AND METHOD FOR POWERING COLD CATHODE FLUORESCENT LIGHTING

(75) Inventor: Richard L. Gray, Saratoga, CA (US)

(73) Assignee: Analog Microelectronics, Inc., Santa Clara, CA (US)

( * ) Notice: Subject to any disclaimer, the term of this patent is extended or adjusted under 35 U.S.C. 154(b) by 38 days.

(21) Appl. No.: 10/083,932

(22) Filed: Feb. 26, 2002

(65) Prior Publication Data

US 2003/0160574 A1 Aug. 28, 2003

(51) Int. Cl.[7] ..... H05B 37/02

(52) U.S. Cl. ..... 315/291; 315/224; 315/307; 315/209 PZ

(58) Field of Search ..... 315/291, 294, 315/307, 209 R, 209 PZ, DIG. 2, DIG. 4, DIG. 5, 224; 310/318

(56) References Cited

U.S. PATENT DOCUMENTS 5,866,969 A 2/1999 Shimada et al. ..... 310/318
5,923,129 A * 7/1999 Henry ..... 315/307
5,923,542 A * 7/1999 Sasaki et al. ..... 310/318
6,133,672 A 10/2000 Sasaki et al. ..... 310/318
6,134,133 A 10/2000 Noma et al. ..... 363/134
6,153,962 A 11/2000 Noma et al. ..... 315/209 PZ
6,184,631 B1 2/2001 Noma et al. ..... 315/224
6,198,198 B1 3/2001 Fujimura et al. ..... 310/316.01
6,198,234 B1 3/2001 Henry ..... 315/291
6,226,196 B1 5/2001 Toshinari et al. ..... 363/134
6,239,558 B1 5/2001 Fujimura et al. ..... 315/307
6,253,066 B1 6/2001 Wilhite et al. ..... 455/108
6,396,722 B2 * 5/2002 Lin ..... 363/98
6,400,096 B1 6/2002 Wells et al. ..... 315/224
6,525,492 B2 * 2/2003 Ribarich ..... 315/291

OTHER PUBLICATIONS

Publication entitled: "One–Cycle Control Of Switching Converters"; Smedley et al.; Power Electronics Group; California Institute of Technology; pp. 1–9.

* cited by examiner

*Primary Examiner*—Dong Wong
*Assistant Examiner*—Ephrem Alemu
(74) *Attorney, Agent, or Firm*—Bever, Hoffman & Harms, LLP; Jeanette S. Harms

(57) ABSTRACT

A frequency provided to power a cold cathode fluorescent light (CCFL) circuit is based on a duty cycle of a driving waveform to the CCFL circuit, wherein the duty cycle of the driving waveform is approximately 50%.

17 Claims, 12 Drawing Sheets

SYSTEM AND METHOD FOR POWERING COLD CATHODE FLUORESCENT LIGHTING

BACKGROUND OF THE INVENTION

1. Field of the Invention

The present invention relates to cold cathode fluorescent lighting (CCFL), and particularly to piezoelectric drive circuitry for the CCFL.

2. Description of the Related Art

Liquid crystal displays (LCDs) are well known in the art of electronics. One of the largest power consuming devices in a notebook computer is the backlight for its LCD. The LCD typically uses a cold cathode fluorescent lamp (CCFL) for backlighting. However, the CCFL requires a high voltage AC supply for proper operation. Specifically, the CCFL generally requires 600 Vrms at approximately 50 kHz. Moreover, the start-up voltage of the CCFL can be twice as high as its normal operating voltage. Thus, over 1000 Vrms is needed to even initiate CCFL operation.

In optimal applications, the battery in the notebook computer must generate the high AC voltages required by the CCFL. To increase valuable battery life, those skilled in the art strive to provide an efficient means to convert this low voltage DC source into the necessary AC voltage. In the prior art, magnetic transformers, have provided the above-described conversion. However, in light of ever decreasing space limitations, magnetic transformers are becoming impractical in notebook applications.

To this end, piezoelectric transformers, which are generally much smaller than their magnetic transformer counterparts, are increasingly being used to provide the DC/AC conversion for the CCFL. A piezoelectric transformer (PZT) relies on two inherent effects to provide the high voltage gain necessary in a notebook application. First, in an indirect effect, applying an input voltage to the PZT results in a dimensional change, thereby making the PZT vibrate at acoustic frequencies. Second, in a direct effect, causing the PZT to vibrate results in the generation of an output voltage. The voltage gain of the PZT is determined by its physical construction, which is known to those skilled in the art and therefore not described in detail herein. Because the PZT has a strong voltage gain versus frequency relationship, the PZT should be driven at a frequency sufficiently close to its resonant frequency.

FIG. 1 illustrates a prior art CCFL circuit 100A described in U.S. Pat. No. 6,239,558, issued to Fujimura et al. on May 29, 2001 (hereinafter Fujimura). CCFL circuit 100A includes two input lines 102 and 103 for controlling a half-bridge formed by p-type transistor 104 and n-type transistor 105. Input lines 102 and 103 receive non-overlapping clock signals, as shown in FIG. 1B. In one embodiment, clock signal 121, which is provided to the gate of p-type transistor 104, can vary between the voltage VBATT provided by a battery 101 (thereby turning off that transistor) and VBATT—VGS, wherein VGS is the gate to source voltage of transistor 104 (thereby turning on that transistor). In this embodiment, clock signal 122, which is provided to the gate of n-type transistor 105, can vary between voltages VGS (thereby turning on that transistor) and VSS (e.g. ground)(thereby turning off that transistor).

Optimally, either p-type transistor 104 or n-type transistor 105 is conducting at any point in time, thereby providing a pulsed square waveform at node N1 that varies between VSS and VBATT. However, realistically, some delay between conducting states of transistors 104 and 105 must be present for reliable operation. Thus, for example, delays 119 and 120 associated with clock signals 121 and 122 can be included to ensure that transistors 104 and 105 are not conducting at the same time, thereby preventing an undesirable energy loss.

In CCFL circuit 100A, an inductor 106 and a capacitor 107 function as a filter to transform the pulsed square waveform at node N1 into a sinusoidal waveform at node N2. Note that a PZT 108 of CCFL circuit 100 typically includes a large input capacitance. Therefore, in some embodiments, capacitor 107 can be eliminated.

PZT 108 includes two input terminals (represented by two horizontal plates in FIG. 1A) coupled respectively to node N2 and VSS as well as one output terminal coupled to a capacitor 109. Capacitor 109 can counteract the negative impedance provided by CCFL 110, thereby stabilizing the loop frequency response if necessary. Of importance, the sinusoidal waveform at node N3 (at the output of PZT 108) has a higher voltage than the sinusoidal waveform at node N2 (at the input of PZT 108). In this manner, the input terminal of CCFL 110 receives a high potential AC signal.

The output terminal of CCFL 110, i.e. node N4, is coupled to VSS via a resistor 113. As explained by Fujimura, the current flowing through resistor 113 can be sensed at node N4 via line 118 and then converted from AC to DC using a rectifier (typically including one or more diodes to force the current in one direction) to provide a voltage that is proportional to the CCFL current. An error amplifier EA compares this rectified voltage to a set reference voltage and then outputs the difference between the two voltages as an amplified comparison result. This amplified signal controls a voltage-controlled oscillator (VCO) that outputs a frequency signal to a drive circuit. This drive circuit provides the non-overlapping clock signals to transistors 104 and 105.

Thus, the above-described control loop uses the frequency signal to control the current through CCFL 110. Specifically, as known by those skilled in the art, PZT 108 has a characteristic frequency response. FIG. 1C illustrates a graph plotting the voltage gain versus frequency for PZT 108, assuming that the effects of inductor 106 and capacitor 107 are ignored. Typically, an initial driving frequency 192 of PZT 108 is started high and then reduced until the desired tube current is reached. Note that the frequencies starting at zero and increasing to a peak frequency 193 result in unstable operation of PZT 108 and therefore are not used. Frequencies lower than peak frequency 193 can result in inefficient operation of PZT 108. Of importance, varying the driving frequency of the non-overlapping clock signals on lines 102 and 103 has corresponding frequency changes on the pulsed waveform at node Ni and the sinusoidal waveform at nodes N2 and N3. Thus, as the frequency changes, the current through CCFL 110 also changes.

One of the disadvantages of CCFL circuit 100A is that large changes in input voltage at battery 101 require the driving frequency to vary widely. In particular, at high input voltages the driving frequency may increase significantly to maintain the tube current at the desired value. However, the most efficient region of PZT operation occurs within a small area just to the high frequency side of the resonant frequency at peak frequency 193. Unfortunately, this area can also force PZT 108 into an inefficient area of operation.

FIG. 1D illustrates a CCFL circuit 100B, also described by Fujimura, for regulating the output voltage of PZT 108 by controlling the duty cycle. Note that similar reference numerals in the figures refer to similar components. In CCFL circuit 100B, resistors 111 and 112 are connected in series between node N3 and VSS, thereby forming a voltage divider. In this manner, a line 117 connected to node N5 between resistors 111 and 112 can be used to detect the output voltage of PZT 108 at node N3. Once again, an error amplifier EA compares the rectified voltage to a set reference voltage. The amplified EA output signal controls a pulse width modulation (PWM) oscillation circuit. The output of the PWM oscillation circuit, in turn, controls the duty cycle of a driving waveform to a driver, which generates the non-overlapping clock signals to transistors 104 and 105. As the duty cycle of this driving waveform increases, which results in having p-type transistor 104 conduct longer and having n-type transistor 105 conduct less, the amplitude of the signal at node N3 increases. Thus, this control loop attempts to regulate the brightness of CCFL 110 by controlling the duty cycle of the driving waveform to the driver, thereby changing the amplitude of the sinusoidal waveform at node N3. In an alternative embodiment, resistors Ill and 112 can be connected to node N2 via line 116. Thus, this control loop also attempts to regulate the brightness of CCFL 110 by controlling the duty cycle of the driving waveform to the driver, this time by changing the sinusoidal waveform at node N2. In yet another alternative embodiment, Fujimura describes substituting a PWM oscillation circuit for the VCO of FIG. 1A. Fujimura indicates that such an embodiment regulates the current through CCFL 110 by controlling the duty cycle of the driving waveform to the driver.

However, because the sinusoidal waveform at node N2 is not symmetric about ground, a standard rectification scheme could incorrectly identify the midpoint of the sinusoidal waveform. Thus, the above-described control loops can incorrectly adjust the brightness of and current through CCFL 110. Therefore, a need arises for an improved system for powering a CCFL.

SUMMARY OF THE PRESENT INVENTION

In accordance with one feature of the present invention, a frequency provided to power a cold cathode fluorescent light (CCFL) circuit is based on a duty cycle of a driving waveform to the CCFL circuit, wherein the duty cycle of the driving waveform is approximately 50%. The present invention includes a plurality of control loops to provide the above-described functionality and other desirable functionalities. In a first control loop, a voltage of the driving waveform can be sensed by a plurality of resistors forming a voltage divider at a first node. The values of the resistors can be determined by a defined duty factor and a high level of the driving waveform. In a preferred embodiment, the defined duty factor is less than 50%.

The first loop can generate a first DC signal that is proportional to a time-averaged voltage at the first node. This function can be provided by a first integrator, which receives the voltage at the first node and a first reference voltage set in accordance with the resistor values, the defined duty factor, and the high level of the driving waveform.

In one embodiment, a first clamp can limit the first DC signal, wherein the first clamp allows selecting one of a plurality of current sources. Specifically, the first clamp is configured to allow the first DC signal to increase at a rate that is no faster than a selected current source can charge a first capacitor in the clamp. A first current source can be used for a cold start-up of the CCFL circuit, whereas a second current source (larger than the first current source) can be used for a warm start-up of the CCFL circuit. In this manner, the present invention advantageously compensates for the type of CCFL start-up operation. The first DC signal is provided to a voltage-controlled oscillator, which outputs a frequency signal in response to the first DC signal.

In a second control loop, a voltage that is proportional to a CCFL current is sensed at a second node. A second DC signal can then be generated that is proportional to a time-averaged voltage at the second node. In one embodiment, the second DC signal can be clamped based on a current source. Specifically, the second clamp is configured to allow the second DC signal to increase at a rate that is no faster than the current source can charge a second capacitor in the clamp. In this manner, the present invention advantageously ensures a soft start-up of the CCFL circuit.

Of importance, a comparator receives both the frequency signal and the second DC signal and outputs a pulse width modulated (PWM) signal. The PWM signal generates the driving waveform for the CCFL circuit. In this manner, the PWM signal is adjusted based on the duty cycle of the driving waveform, wherein the duty cycle is approximately 50%.

In accordance with another feature of the present invention, a ramp generator circuit can generate an interrupt signal that controls the brightness of the CCFL circuit. This interrupt signal is separate from the PWM signal, but also affects the driving waveform. Specifically, the interrupt signal can generate a driving waveform that turns the CCFL circuit off and on at a frequency that is higher than the human eye can detect, but much lower than the driving frequency of the CCFL.

In one embodiment of the present invention, a third control loop provides detection of potentially dangerous voltage conditions across the CCFL. The third control loop can include a third node that provides a voltage proportional to the voltage across the CCFL as well as fault logic that can output another interrupt signal. However, this interrupt signal triggers the CCFL circuit to only turn off (i.e. it cannot turn the CCFL circuit back on).

In accordance with the present invention, clamping circuitry for a line can include a comparator, a transistor, a capacitor, at least one current source, and a switch. The transistor has a source connected to a predetermined voltage source, a gate connected to an output terminal of the comparator, and a drain connected to a positive input terminal of the comparator and the line. The capacitor has a first terminal connected to the predetermined voltage source and a second terminal connected to a negative input terminal of the comparator. At least one current source is connected to the negative input terminal of the comparator. Finally, the reset switch is connected to the negative input terminal of the comparator, wherein the reset switch selectively provides a path connected to the predetermined voltage source. In one embodiment, the predetermined voltage source is VSS or ground, and the transistor is an n-type transistor. In the case that more than one current source is provided, the clamping circuitry can include a current switch for selectively connecting a first current source or a second current source to the negative input terminal of the comparator.

In the present invention, a method for controlling a voltage increase on a line includes limiting the voltage increase to a first predetermined amount based on a first current source and a capacitor, and selectively resetting a voltage of the capacitor to zero. The method can further include switching to a second current source, thereby limiting the voltage increase to a second predetermined amount based on the second current source and the capacitor. In other words, the clamping circuit is configured to allow the voltage on the line to increase at a rate that is no faster than the selected current source can charge the capacitor. In this manner, the present invention advantageously ensures a soft start-up of the CCFL circuit.

In accordance with another feature of the present invention, a high side driver provides a drive signal to a CCFL circuit. The high side driver can include a first pulse generator circuit for pulling the drive signal up to a first predetermined value during a first transition of an input signal to the driver. A first current source circuit maintains the first predetermined value during a first state of the input signal. A second pulse generator circuit can pull the drive signal down to a second predetermined value during a second transition of the input signal. Finally, a second current source circuit can maintain the second predetermined value during a second state of the input signal.

Typically, the first pulse generator circuit, the first current source circuit, the second pulse generator circuit, and the second current source circuit can include an n-type transistor comprising a lightly doped drain, thereby allowing this drain to withstand higher voltages than a normally doped drain. Additionally, the first pulse generator circuit, the first current source circuit, the second pulse generator circuit, and the second current source circuit can include a p-type transistor coupled to a device with diode characteristics, e.g. a clamp or a zener diode, for protecting the p-type transistor. In this manner, the high side driver can advantageously receive a high battery voltage without breakdown during operation.

BRIEF DESCRIPTION OF THE DRAWINGS

FIG. 3A also includes a legend for FIGS. 3B, 3C, and 3D.

DETAILED DESCRIPTION OF THE DRAWINGS

Figure 1A:
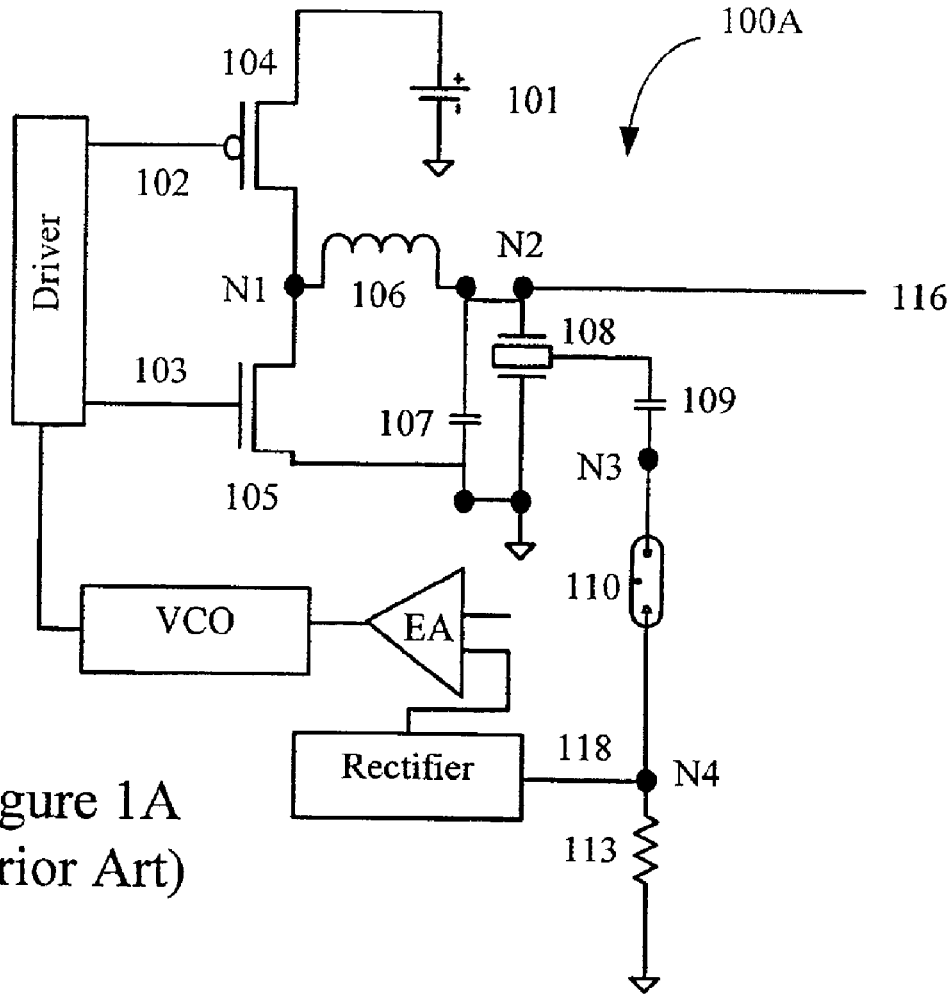
Figure 1A (Prior Art)
FIG. 1A illustrates a conventional CCFL circuit that regulates the current through the CCFL by controlling the frequency of the driving waveforms to a piezoelectric device.
Figure 1B:
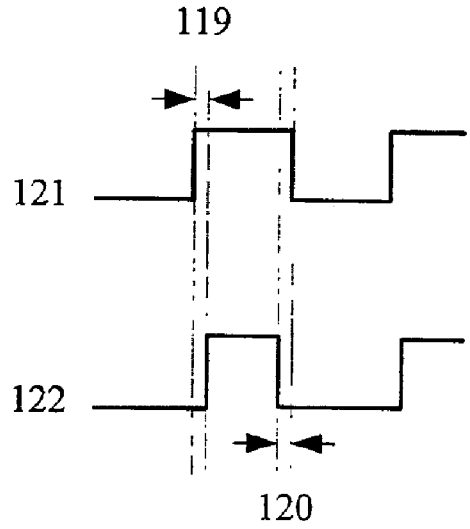
Figure 1B (Prior Art)
FIG. 1B illustrates two non-overlapping clock signals that can be provided to the conventional CCFL circuit shown in FIG. 1A.
Figure 1D:
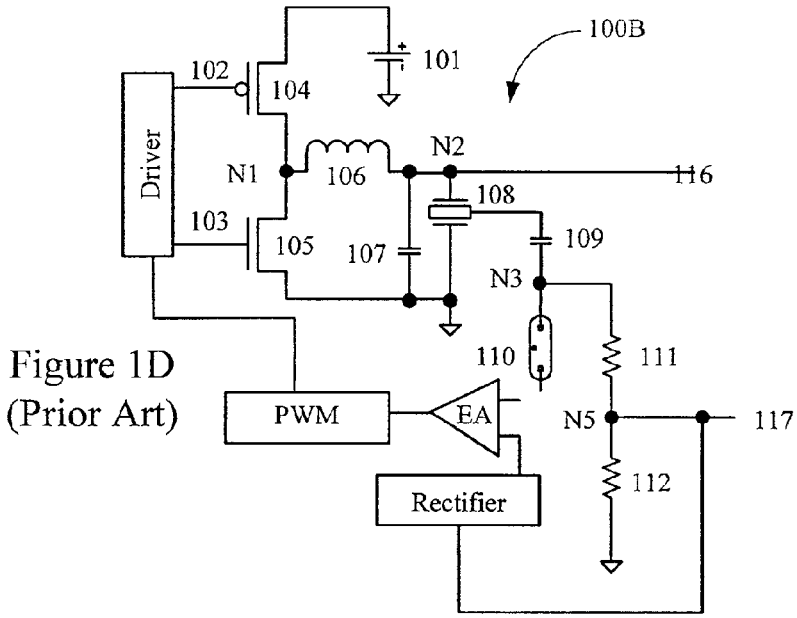
Figure 1D (Prior Art)
FIG. 1D illustrates another conventional CCFL circuit that can change the amplitude of the sinusoidal waveform provided to the CCFL by controlling a duty cycle of the driving waveforms to a piezoelectric device.
Figure 1C:
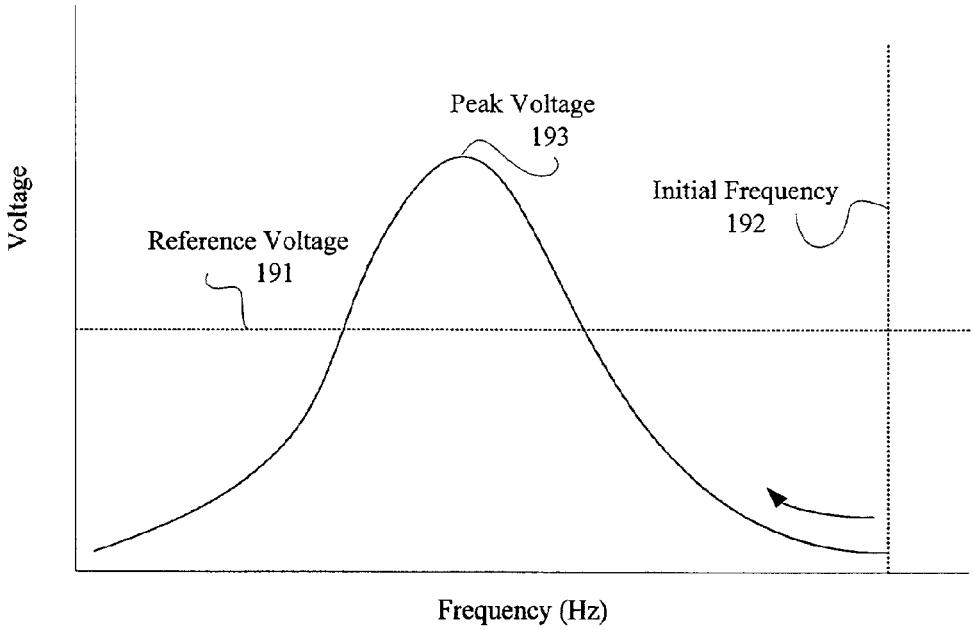
FIG. 1C illustrates a graph that plots the voltage gain of the PZT versus the frequency.
Figure 2A:
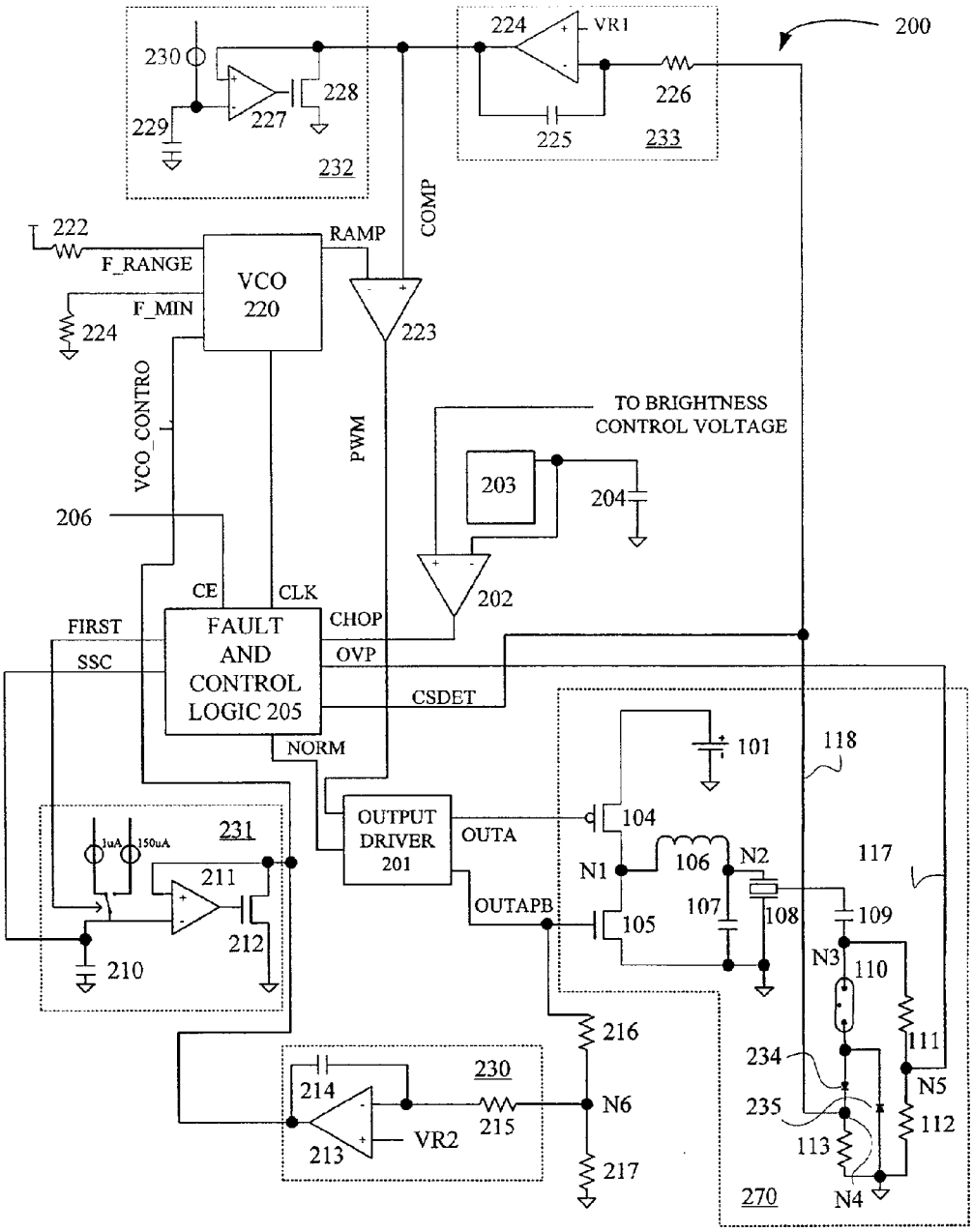
FIG. 2A illustrates a CCFL system in accordance with the present invention.

FIG. 2A illustrates a system 200 in accordance with the present invention. System 200 includes a CCFL circuit 270, which includes the components described in detail in reference to CCFL circuits 100A and 100B (FIGS. 1A and 1D, respectively). CCFL circuit 270 further includes a diode 234 connected between the output terminal of CCFL 110 and resistor 113 as well as a diode 235 connected between the output terminal of CCFL 110 and VSS. The operation of system 200 including CCFL circuit 270 will now be described in further detail.

In accordance with the present invention, the current through CCFL 110 is controlled by a combination of the duty cycle of a waveform that drives transistor 105 and the frequency of that same waveform. Specifically, system 200 includes a first control loop connected to node N4 that provides a DC signal COMP to a positive terminal of a comparator 223. System 200 further includes a second control loop connected to a node N6 that provides a signal RAMP (sawtooth waveform) to a negative terminal of comparator 223. The output signal of comparator 223, i.e. a PWM signal (a pulsed waveform), is provided to an output driver 201, which in turn provides the non-overlapping clock signals OUTA and OUTAB to transistors 104 and 105 (i.e. the driving waveforms to CCFL circuit 270). Of importance, the second control loop of the present invention can be used to change the frequency of the driving waveform to transistors 104 and 105 such that its duty cycle approaches a set value (e.g. 50%), thereby increasing the efficiency of system 200. As the voltage of battery 101 increases, the oscillator frequency eventually reaches a lower limit set by the system designer. At that point, the duty cycle will decrease below its set value (e.g. 50%) to maintain proper regulation of the CCFL current.

In accordance with one embodiment, battery 101 can provide a voltage source between 7–24V (typical for 3 lithium ion cells provided in a notebook computer application), inductor 106 has an inductance of 22 uH, capacitors 107 and 109 have capacitances of 47 nF and 33 pF, respectively, and resistors 111, 112, and 113 have resistances of 10 MOhm, 5 kOhm, and 1 kOhm, respectively. Note that other components illustrated in FIGS. 2A and 2C will be described as having resistances or capacitances with reference to this embodiment. However, those skilled in the art will recognize that in other embodiments the components of system 200 can have other values. Therefore, the present invention is not limited to the values of one embodiment.

First Control Loop

As described above, the current through CCFL 110 can be sensed on line 118, wherein the voltage across resistor 113 is proportional to the CCFL current. In accordance with one feature of the present invention, that voltage can drive an input of an integrator 233. Specifically, integrator 233 receives the voltage on line 118 through a resistor 226, wherein resistor 226 is coupled to the negative terminal of an error amplifier 224. In one embodiment, resistor 226 provides a resistance of 10 kOhm. Error amplifier 224 compares this voltage with a reference voltage VR1 received on its non-inverting terminal.

In one embodiment, reference voltage VR1 is derived from a temperature and supply stable reference (such as a bandgap reference) through a resistor divider. Other known techniques for providing reference voltage VR1 can also be used. In one embodiment, reference voltage VR1 can be between 0.5 V and 3.0 V. Note that the larger the reference voltage VR1, the larger the average voltage across resistor 113. In contrast, if reference voltage VR1 is too small, then error amplifier offsets and other non-idealities may become significant. Therefore, in one embodiment, reference voltage VR1 can be 2.5 V.

A capacitor 225, in one embodiment providing a capacitance of 1 uF, is coupled to the negative terminal and the output terminal of error amplifier 224, thereby completing the formation of integrator 233. The purpose of integrator 233 is to generate a DC signal COMP such that the time-averaged voltage at node N4 is substantially equal to reference voltage VR1.

In one embodiment, the COMP signal can be limited by a clamping circuit 232. Clamping circuit 232 includes an error amplifier 227 providing an output signal to the gate of a transistor 228. Transistor 228, an n-type transistor, has its source coupled to VSS and its drain coupled to the positive input terminal of error amplifier 227 as well as to the output of integrator 233. Error amplifier 227 further includes a negative input terminal coupled to a current source 230 and one terminal of a capacitor 229 (the other terminal being coupled to VSS). In this configuration, clamping circuit 232 allows the COMP signal to increase at a rate that is no faster than current source 230 can charge capacitor 229. Thus, clamping circuit 232 prevents the COMP signal (and thus the PWM signal) from immediately going to its full power mode, thereby allowing CCFL 110 to start up slowly. Having a gradual increase of the power to CCFL 110 advantageously prolongs its life as well as the life of other components of CCFL circuit 270.

Second Control Loop

In accordance with the present invention, the second control loop can include two resistors 216 and 217 connected between the gate of transistor 105 and VSS, thereby forming a voltage divider such that a node N6 (located between resistors 216 and 217) provides a voltage proportional to the OUTAPB signal. That voltage drives an input of an integrator 230. Specifically, integrator 230 receives the voltage from node N6 through a resistor 215, wherein resistor 215 is coupled to the negative terminal of an error amplifier 213. In one embodiment, resistor 215 provides a resistance of 20 kOhm. Error amplifier 213 compares this voltage with a reference voltage VR2 received on its positive input terminal. A capacitor 214, in one embodiment providing a capacitance of 0.022 uF, is coupled to the negative input terminal and the output terminal of error amplifier 213, thereby completing the formation of integrator 230. The purpose of integrator 230 is to generate a DC signal at VCO_Control such that the time-averaged voltage at node N6 is substantially equal to reference voltage VR2.

In accordance with the present invention, the values of resistors 216 and 217 are preferably chosen such that the high level of the OUTAPB signal multiplied by the desired duty factor DF and further multiplied by the resistor divider ratio of resistors 216 and 217 is equal to the reference voltage VR2. In mathematical terms, this relationship is described in Equation 1:

$$R217/(R216+R217)*VOH*DF=VR2 \quad \text{(Equation 1)}$$

wherein R216 and R217 are the resistances of resistors 216 and 217, respectively, and VOH is the high level of the OUTAPB signal. Note that if the average value of the OUTAPB signal is equal to the reference voltage VR2, then the duty cycle of the OUTAPB signal is close to 50%. As determined by the assignee of the present invention, a switching circuit with a 50% duty cycle has lower root-mean-square (RMS) currents than a similar circuit running at a smaller duty cycle. Thus, a 50% duty cycle leads to fewer I squared R losses and higher operating efficiency. Additionally, a 50% duty cycle signal, when driving the LC network (comprising inductor 106 and capacitor 107) near its resonant frequency, produces less unwanted higher order harmonic frequencies at node N2 than a driving signal at a much lower duty cycle.

In accordance with the present invention, the integrator 230 outputs a VCO_CONTROL signal to a voltage-controlled oscillator (VCO) 220, which in turn generates the RAMP signal. The frequency of the RAMP signal (a saw-tooth waveform) decreases as the VCO_CONTROL voltage increases. The minimum operating frequency of VCO 220 can be set by a resistor 224, which is coupled to supply voltage VSS. In one embodiment, resistor 224 has a resistance of 45 kOhm and is coupled to ground. The adjustment range of VCO 220 can be set by a resistor 222, which is coupled to a supply voltage VDD. In one embodiment, resistor 222 has a resistance of 200 kOhm and is coupled to a 5V power supply.

In one embodiment, the duty factor DF is set to a number slightly less than 50%. In this manner, error amplifier 213 can always output an appropriate voltage to decrease the driving frequency of the RAMP signal (via VCO 220) and thus provide the necessary output power. Since the maximum duty factory allowed by the output driver, 201, is 50%, and if, by adjusting the resistance values of 216 and 217, the duty factor DF were set equal to 50%, then no differential voltage would be available at the input terminals of error amplifier 213. In that case, the frequency of the RAMP signal could not drop and the power to CCFL 110 could not increase. In other words, the second control loop could get "stuck" at a frequency that did not output enough output power.

For example, in actual operation starting at a low battery voltage, the duty cycle increases to its maximum, i.e. 50%, to supply the required power to CCFL 110. However, in light of the concern addressed in the preceding paragraph, assume that the duty factor DF was set to 45% by providing the appropriate resistance values to resistors 216 and 217. Thus, at this point, the actual duty cycle (50%) is higher than the target point (45%). In this case, the average voltage at node N6 sensed by integrator 230 is lower than the reference voltage VR2, thereby causing the VCO_CONTROL signal to increase. This increase causes VCO 220 to decrease the frequency of the RAMP signal (and the PWM signal), thereby increasing the transferred power across PZT 108. Eventually, as the battery voltage is increase, the duty cycle of the OUTAPB signal (i.e. the driving waveform) does not need to be 50% to supply the required current for CCFL 110. At this point, the duty cycle drops to 45% and equilibrium prevails.

As the voltage of battery 101 increases, the frequency of the driving waveform will increase, thereby keeping the current through CCFL 110 constant until VCO 220 reaches its maximum frequency. At this point, irrespective of further increases in the battery voltage, the frequency cannot change as VCO 220 has achieved its maximum frequency. Thus, as the voltage of battery 101 increases beyond this point, the duty cycle will be decreased to maintain regulation.

Start-Up Operations

In one embodiment, the VCO_CONTROL signal can be limited by a clamping circuit 231. Clamping circuit 231 includes an error amplifier 211 providing an output signal to the gate of a transistor 212. Transistor 212, an n-type transistor, has its source coupled to VSS and its drain coupled to the positive input terminal of error amplifier 211 as well as to the output of integrator 231. In this configuration, clamping circuit 231 allows the signal VCO_CONTROL to increase at a rate that is no faster than a selected current source can charge a capacitor 210. Specifically, in this embodiment, clamping circuit 231 further includes two circuit sources, one at 1 uA and another at 150 uA, which are selectively connected to the negative input terminal of error amplifier 211 as well as to one terminal of capacitor 210. Capacitor 210 has its other terminal connected to VSS. In one embodiment, capacitor 210 has a low capacitance of 0.022 uF.

During a "cold" start-up operation of CCFL 110, i.e. a start-up following a predetermined period of time in which CCFL 110 has been off, fault and control logic 205 generates an active signal FIRST, thereby resulting in clamping circuit 231 selecting the lower value current source (i.e. 1 uA, in this embodiment). In contrast, during subsequent "warm" starts, i.e. a start-up following a time period less than the predetermined period of time, fault and control logic 205 generates an inactive signal FIRST, thereby resulting in clamping circuit 231 selecting the higher value current source (i.e. 150 uA). In this manner, capacitor 210 takes longer to charge during a cold start-up than a warm start-up.

If error amplifier 211 receives a lower voltage on its negative input terminal compared to the VCO_CONTROL signal received on its positive input terminal, then the output of error amplifier 211 increases, thereby turning on transistor 212 and providing a pull-down on the VCO_CONTROL line. If error amplifier 211 receives a higher voltage on its negative input terminal compared to the VCO_CONTROL signal received on its positive input terminal, then the output of error amplifier 211 decreases, thereby turning off transistor 212 and allowing the voltage on the VCO_CONTROL line to increase as controlled by integrator 230. In this manner, the present invention ensures that a cold start-up for CCFL 110 is much slower than warm start-ups.

CCFL Dimming

In accordance with one feature of the present invention, dimming can be accomplished by turning CCFL 110 on and off at a frequency that is higher than the human eye can detect, but much lower than the driving frequency of the CCFL. For example, if the driving frequency of CCFL 110 is 50 kHz, then the dimming frequency might be 200 Hz. As the duty cycle of the on/off signal goes from 0 to 100% then the average tube brightness will also vary from 0 to 100%. In one embodiment, a ramp generator 203 can generate a sawtooth waveform whose slope is limited by a small capacitor 204. In one embodiment, capacitor 204 has a capacitance of 0.015 uF. A comparator 202 can compare this sawtooth waveform with a BRIGHTNESS CONTROL VOLTAGE, e.g. a DC voltage, which is proportional to the desired brightness. Based on this comparison, comparator 202 outputs a variable duty factor signal CHOP.

Figure 2B:
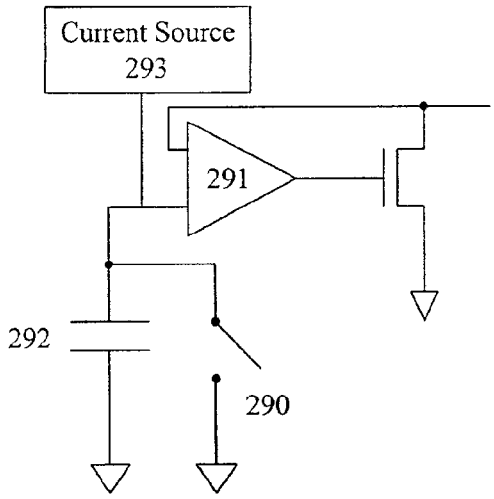
FIG. 2B illustrates clamping circuitry including a reset switch in accordance with one embodiment of the present invention.

Of importance, the CHOP signal, by forcing the NORM signal low, can stop output driver 201 from switching and can also reset capacitors 210 and 229 to 0 volts. Thus, when the CHOP signal is active, clamping circuits 230 and 232 significantly limit the voltage on the first and second control loops. In this manner, the present invention ensures smooth dimming operations with very little overshoot. In one embodiment of generic resetting circuitry shown in FIG. 2B, an active CHOP signal closes a switch 290 that is connected between a capacitor 292 and comparator 291, thereby shunting the current from a current source 293 to ground and discharging capacitor 292. Similar resetting circuitry can be provided for capacitors 210 and 229.

Third Control Loop

In accordance with another feature of the present invention, a third control loop can determine undesirable voltages provided across CCFL 110. Specifically, the third control loop includes two resistors 111 and 112 coupled between node N3 and VSS, thereby forming a voltage divider. In this configuration, a node N5 between transistors 111 and 112 provides an OVP signal proportional to the voltage across CCFL 110. Node N5 is connected to fault and control logic 205 via line 117. If the OVP signal (and thus CCFL voltage) is too high, then a long active CHOP signal generated by fault and control logic 205 can actually shut down CCFL circuit 270 to prevent potentially dangerous conditions from developing. In other words, if the voltage at node N3 is too high, then fault and control logic 205 will turn off the chip regardless of the current operating mode.

In one embodiment, fault and control logic 205 is semi-disabled for a predetermined period of time after either a cold or warm start-up. This semi-disabled period is desirable because CCFL voltages both above and below normal can be experienced when the voltages on capacitors 210 and 229 are ramping upwards. As noted above, there is no "blanking" period for the over-voltage check. However, fault and control logic 205 can also check to see that there are no under-voltages at node N3. In one embodiment, the under-voltage fault check must receive four consecutive periods of under-voltage operation before fault and control logic 205 generates a fault signal and shuts the chip down. In this manner, fault and control logic 205 prevents an unwanted shutdown down to a single spurious under-voltage event. After the semi-disabled time, fault and control logic 205 can again be fully enabled.

In accordance with one feature of the invention, fault and control logic 205 can also receive a CSDET signal from node N4. Thus, fault and control logic 205 can look for under-voltage conditions (tube under-current) at node N4. Once again, this fault check can be disabled for a certain period after each start up cycle (similar to the under-voltage check of node N3). In one embodiment, fault and control logic 205 must receive four consecutive periods of under-voltage operation at node N4 before fault and control logic 205 generates a fault and shuts the chip down.

Figure 2D:
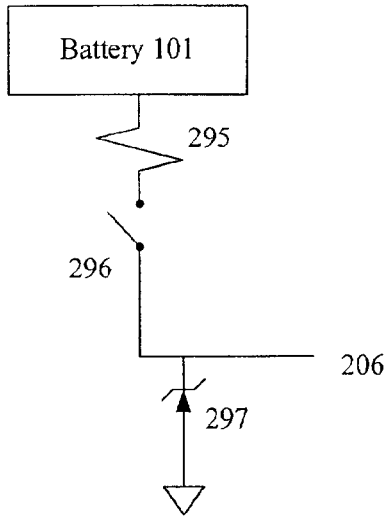
FIG. 2D illustrates circuitry for providing a chip enable signal for the CCFL system of the present invention.

Fault and control logic 205 also receives a chip enable CE signal on line 206. FIG. 2D illustrates one example of additional circuitry for generating the CE signal. Specifically, battery 101 and a resistor 295 (for example, having a resistance of 1 Mohm) are selectively coupled to line 206 using a switch 296. Switch 296 can be activated by a microprocessor or a user-controlled switch (neither shown). A device 297 having zener diode characteristics (e.g. a nominal breakdown voltage of 3 V) is connected between line 206 and VSS, thereby limiting the voltage on line 206 after switch 296 is activated.

Figure 2C:
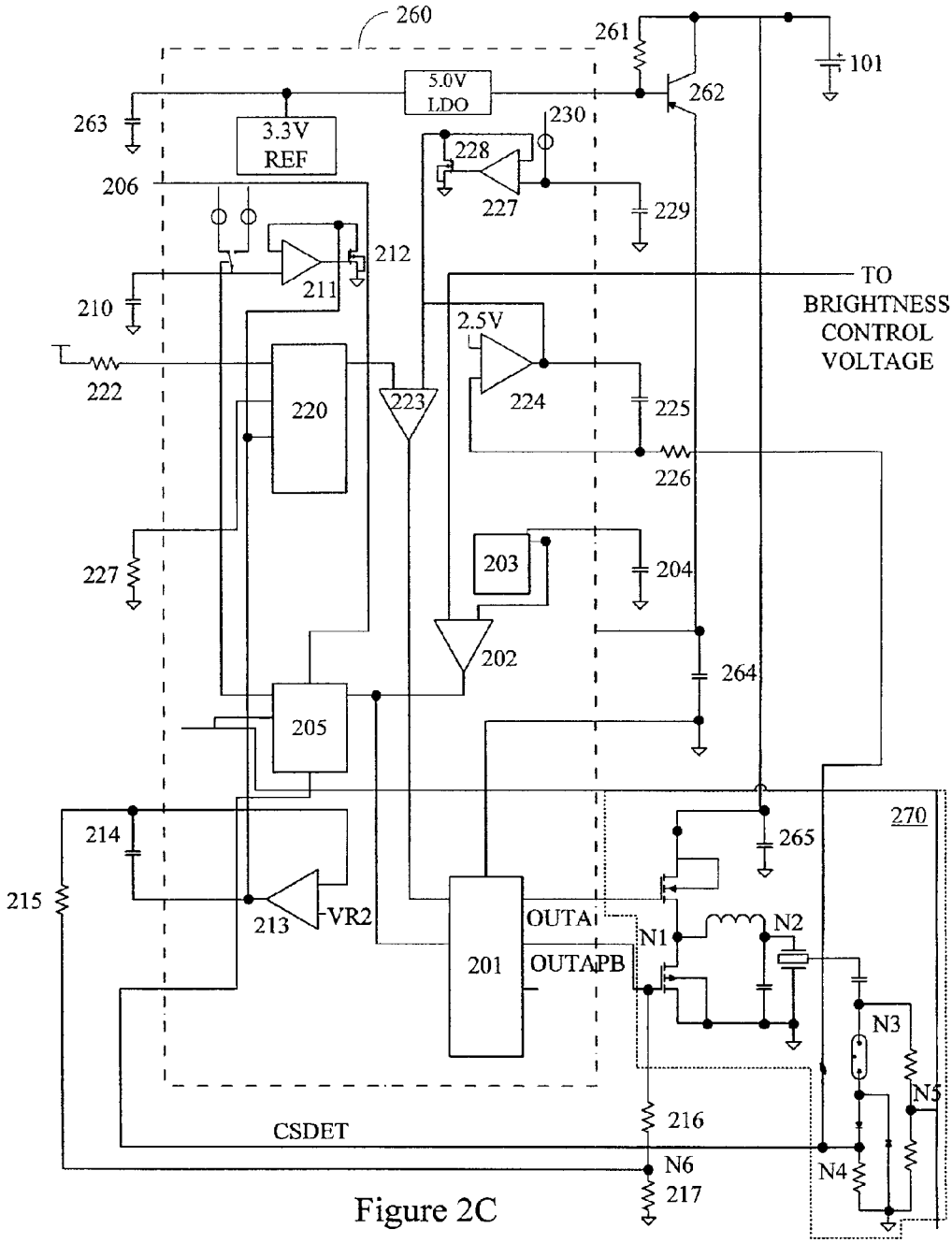
FIG. 2C illustrates one layout of the CCFL system of FIG. 2A.
Figure 2E:
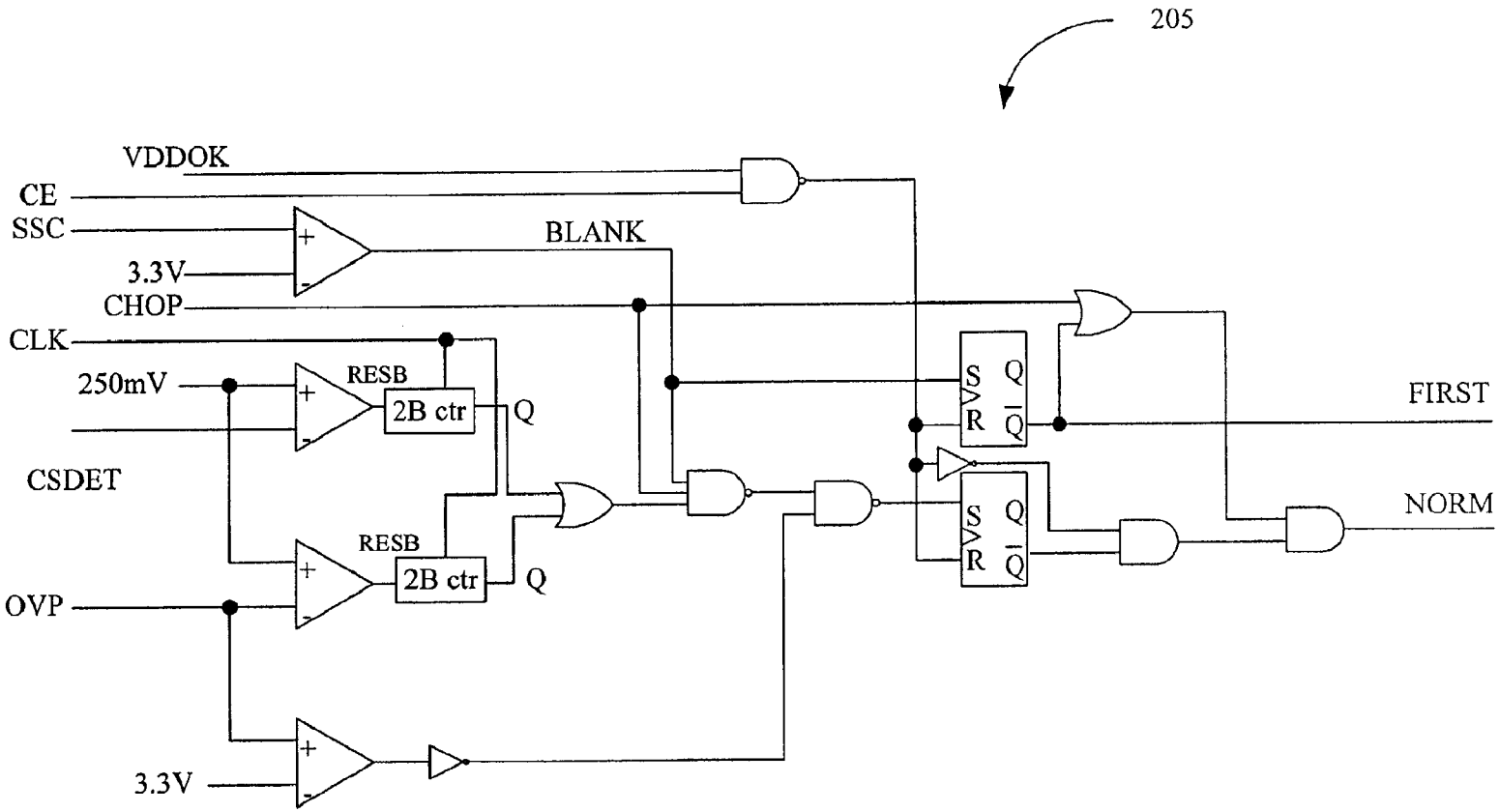
FIG. 2E illustrates one embodiment of the fault and control logic of the present invention.

FIG. 2E illustrates one simplified schematic of fault and control logic 205. The signal, VDDOK, comes from a circuit that detects if the 5V VDD supply is within regulation. It will not allow the circuit to operate if the 5V VDD supply is not in regulation. The CLK signal is the clock output from the VCO. The CLK signal provides the time base for the gate drive of the external FETs. There are two outputs from fault and control logic 205, FIRST and NORM. The FIRST signal has been previously described. When the NORM signal is high the controller is "on" driving the external FETs and producing light in the CCFL. When NORM is low the circuit is turned "off". NORM is low if a fault condition has occurred, during the "off" portion of burst mode dimming cycles, and when the chip is disabled. The SSC signal is one of two capacitor-controlled ramps available in the system for soft start purposes. Its function as a soft start feature is described elsewhere. In FIG. 2E, the SSC signal is used to provide a time delay during which time two of the fault detection checks are disabled. At the beginning of every dimming cycle SSC starts at 0V and ramps linearly up to the 5V supply. The BLANK signal is low while SSC is below 3.3V effectively disabling the two fault checks associated with the 2 bit counters.

FIG. 2C illustrates one layout for system 200 of FIG. 2A. Note that similar reference numerals denote similar components. Additional components can be included in system 200 as shown in FIG. 2C. Specifically, additional components can include, for example, resistor 261, a pnp transistor 262, as well as capacitors 263, 264, and 265. Capacitor 263, in one embodiment having a capacitance of 1 uF, functions to regulate the on-chip reference voltage (in one embodiment, 3.3V). Capacitor 264, pull-up resistor 261, and pnp transistor 262 form a linear regulator that can provide a VDD supply voltage from battery 101. In one embodiment, resistor 261 can provide a resistance of 2 kOhm, capacitor 264 can provide a capacitance of 4.7 uF, and pnp transistor 262 can provide a base-emitter voltage of 0.6V.

Capacitor 265, in this embodiment can serve as a bypass capacitor, which effectively regulates the high AC current from battery 101. In one embodiment, capacitor 265 can provide a capacitance of 4.7 uF. A dashed box 260 indicates that the components therein can be fabricated on one chip.

High Side Driver

In accordance with one feature of the present invention, output driver 201 can use battery 101 as its voltage source. In this manner, the present invention can advantageously eliminate any additional voltage sources (such as heavy and/or cumbersome external battery packs) for target user applications (including, for example, notebook computers). Of importance, the present invention provides this advantage while maintaining a 5V CMOS process, thereby providing maximum portability (i.e. ability to transfer the fabrication process) at minimal cost.

Figure 5:
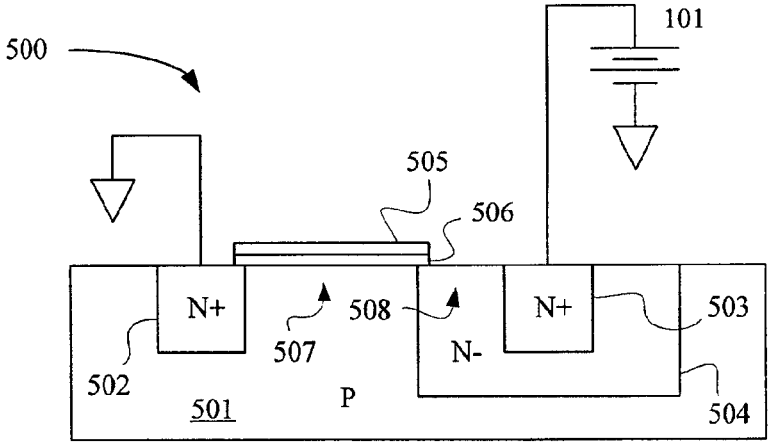
FIG. 5 illustrates a cross-sectional view of a high voltage n-type transistor in accordance with the present invention.

In one embodiment, transistors exposed to the battery voltage can include a high voltage drain extension or are coupled to devices with diode characteristics for limiting the voltage across those transistors. FIG. 5 illustrates a high voltage n-type (HVN) transistor 500 that includes a high voltage drain extension. HVN transistor 500 includes an N+ source region 502 formed in a P substrate 501. HVN transistor 500 further includes a drain region formed by an N+ region 503 and a lightly doped N− region 504, both formed in substrate 501. A gate 505 and its associated oxide layer 506 are formed over a channel region 507 in substrate 501. Of importance, gate 505 extends to N− region 504, but not to N+ region 503. In this configuration, the electric field concentration in an area 508 is significantly less than if gate 505 extended to N+ region 503. In this manner, battery 101 can be advantageously connected directly to N+ region 503 in the drain (and VSS can be connected to N+ source region 502) without damage to HVN transistor 500 during operation.

In another embodiment, N− region 504 can be formed only adjacent to N+ region 503 (i.e. not in a well as shown). In other words, N− region 504 could be formed in area 508 while still providing the same functionality.

Figure 3A:
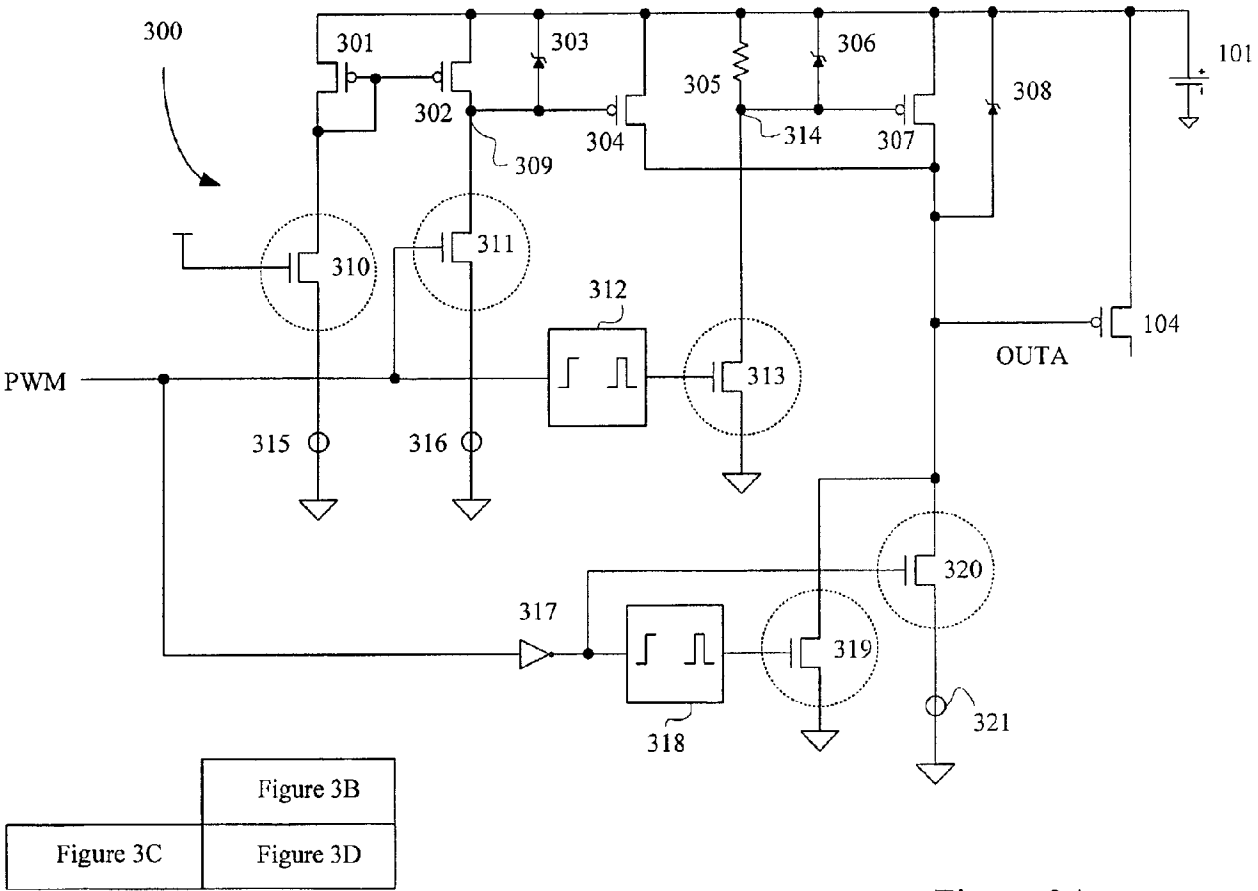
FIG. 3A illustrates a high side driver for one embodiment of the output driver in the present invention.

FIG. 3A illustrates one embodiment of a high side driver 300 for driving transistor 104, wherein high side driver 300 includes HVN transistors (indicated by dashed circles). High side driver 300 further includes the devices with voltage clamping characteristics for limiting the voltage across any p-type transistors exposed to the battery voltage. These devices can be zener diodes or any type of device that has a similar I-V curve to a zener diode.

The purpose of driver 300 is to drive the gate of transistor 104 up to its source potential (e.g. 24V maximum) and down to a voltage set by the breakdown voltage of a diode 308. Of importance, the load produced at the gate of transistor 104 is strictly capacitive. Thus, although the gate of transistor 104 is driven up and down very quickly (e.g. in less than 50 nS), it is unnecessary to provide much DC current to maintain the state of that gate.

In driver 300, if signal PWM is a logic 0, then inverter 317 outputs a logic 1, thereby turning on HV transistor 320. In this state, a current source 321 can pull the OUTA signal low until that signal is clamped by diode 308. Because signal PWM is a logic 0, HVN transistor 311 is turned off. However, HVN transistor 310 is turned on because its gate is connected to VDD. At this point, a current source 315 can pull the gates of transistors 301 and 302 low, thereby allowing them to conduct. With transistor 302 conducting, node 309 is pulled up to the battery voltage, which then turns off transistor 304. Note that pulse units 312 and 318 output logic 1 signals only if signal PWM is transitioning from low to high. Thus, at this point, both transistors 313 and 319 are turned off. Because transistor 313 is turned off, node 314 can rise to the battery voltage, thereby turning off transistor 307. Therefore, with signal PWM at logic 0, signal OUTA is forced as low as diode 308 will allow.

In high side driver 300, when signal PWM transitions from low to high, pulse unit 312 generates a very short logic 1 pulse at the gate of HVN transistor 313 (in one embodiment, approximately 100 nS), thereby driving node 314 lower until it is clamped by diode 306. At this point, transistor 307 turns on strongly, thereby quickly driving signal OUTA to the battery voltage. The now high PWM signal, inverted by inverter 317, turns off HVN transistor 320, thereby preventing current source 321 from affecting signal OUTA. There is no change at transistor 319 because pulse unit 318 senses a high to low transition via inverter 318. The logic one PWM signal turns on HVN transistor 311, thereby allowing current source 316 to pull node 309 as low as diode 303 will allow. This low voltage turns on transistor 304 which will hold signal OUTA high after HV transistor 313 has turned off. Thus, signal OUTA will stay high with only the modest bias currents provided by current sources 315 and 316.

Note that diode 303, which has its anode connected to the gate of transistor 304 and its cathode connected to the source of transistor, protects the gate of transistor 304 by restricting its gate to source voltage. Similarly, diode 306 and 308 protect the gates of transistors 307 and 104, respectively, by restricting their gate to source voltages. In one embodiment, the breakdown voltages of diodes 303, 306, and 308 are approximately 5 to 8 volts.

When the PWM signal transitions from high to low, pulse unit 318 generates a pulse at the gate of HV transistor 319 (approximately 100 nanoseconds, in one embodiment), thereby pulling signal OUTA down as far as diode 308 will allow. Diode 308 must be capable of supplying the transient current, which could be considerable, through HV transistor 319. After the pulse, HV transistor 319 turns off and HV transistor 320 is left on, thereby allowing a current source 321 to pull down the OUTA signal until that signal is clamped by diode 308.

Figure 3B:
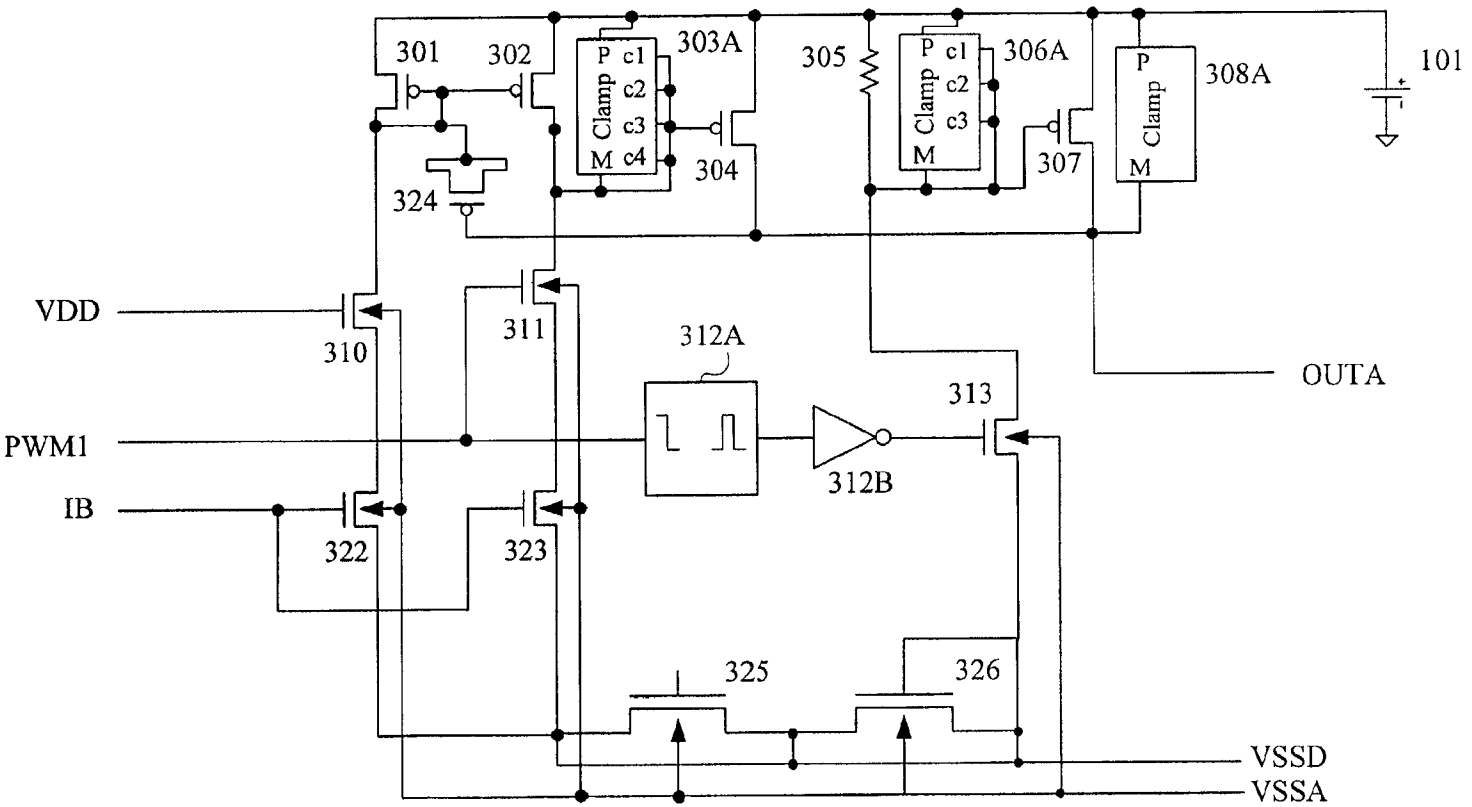
FIGS. 3B, 3C, and 3D illustrate one embodiment of an output driver in accordance with the present invention.
Figure 3C:
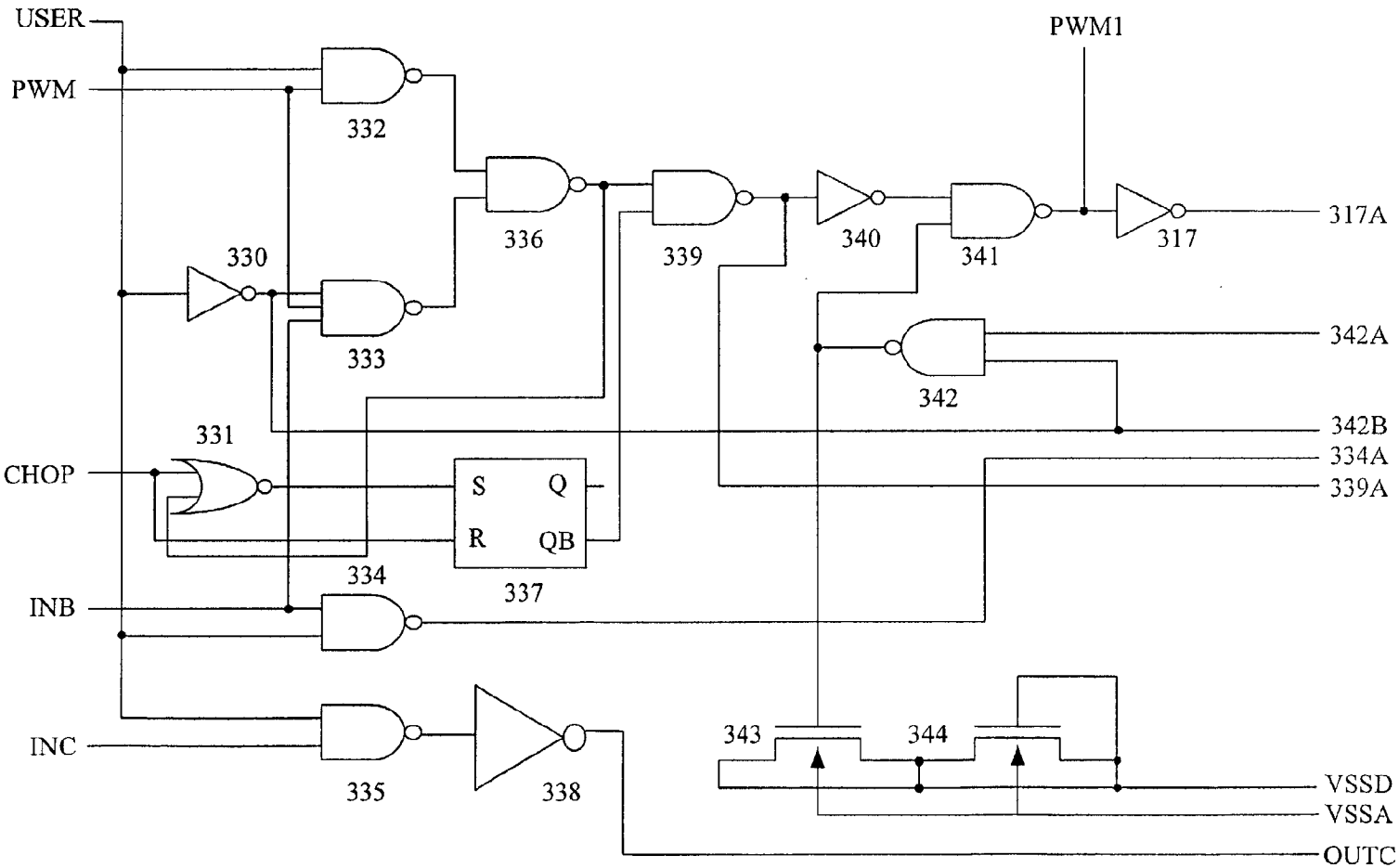
Figure 3D:
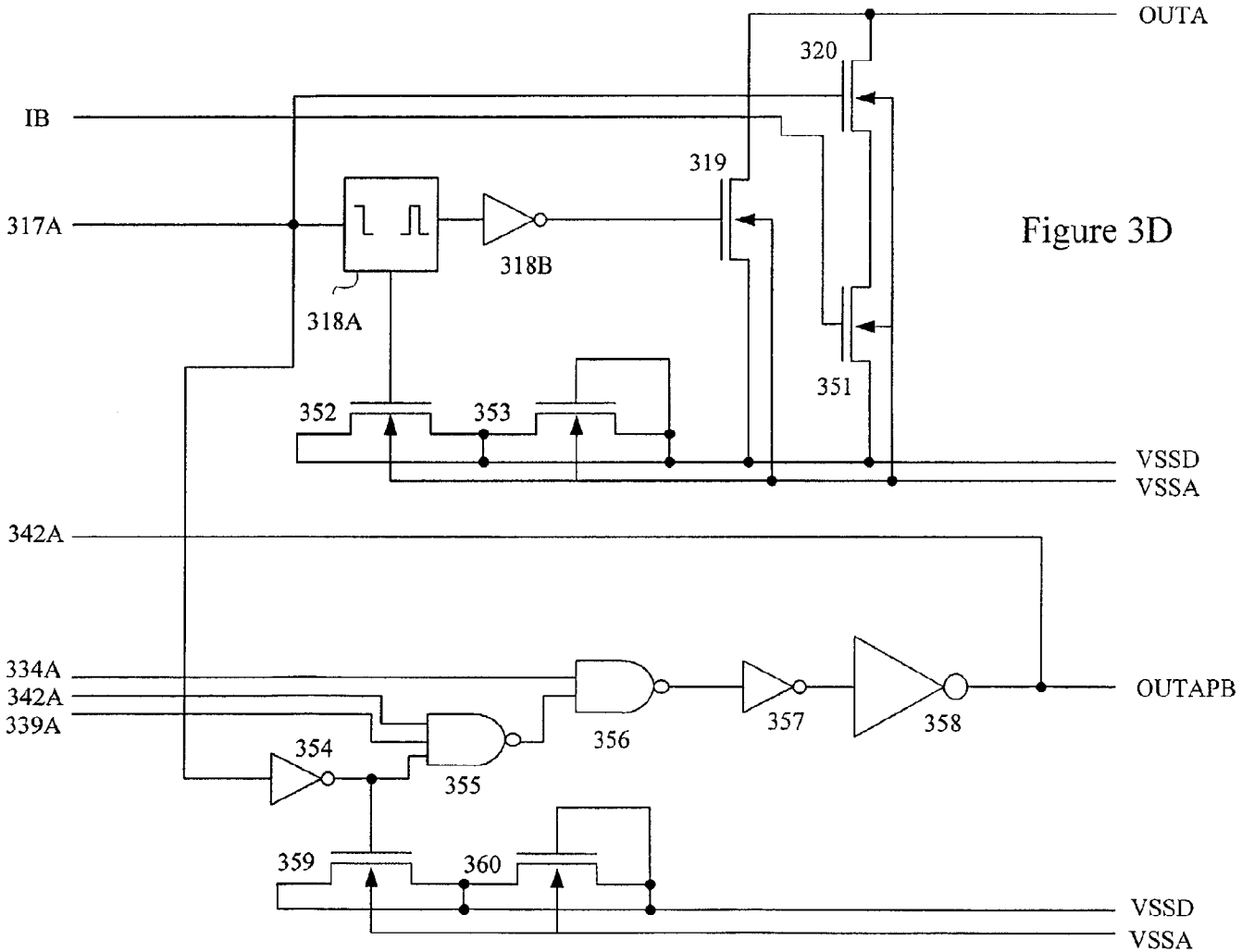

FIGS. 3B, 3C, and 3D (legend appearing on FIG. 3A) illustrate a detailed embodiment of output driver 201 including a high-side driver 300. Note that like reference numeral refer to like components. Further note that the general designation for VSS (i.e. ground in FIG. 3A) is, in a preferred embodiment, divided into VSSD (i.e. a digital VSS, which could be, but is not necessarily, connected to the substrate) and VSSA (i.e. an analog VSS, which is connected to the substrate).

The output driver of FIGS. 3B, 3C, and 3D can advantageously drive the above-described CCFL circuit 270 or a standard wire-wound transformer (not shown). Specifically, the user can provide an appropriate USER signal to use the output driver to drive the half-bridge of the CCFL circuit (USER=0) or a push-pull circuit of a wire-wound transformer (USER=1).

In the half bridge case (USER=0), the signals INB and INC become irrelevant as they are blocked by gates 334 and 335. Output OUTC is essentially disabled. Outputs OUTA and OUTAPB, which are controlled by the PWM signal, are in phase but level-shifted to different voltage levels. There is a small make-before-break delay between outputs OUTA and OUTQPB to prevent simultaneous conduction of the external MOSFETs. The PWM signal propagates through gates 330,333,336,339,340, and 341 (each of which is an inverting stage) to the node PWM1 (which is in phase with the PWM signal because of the even number of inverting stages between PWM and PWM1). The CHOP signal halts switching by setting the latch 337, thereby causing signal QB to go low and blocking the PWM signal path at gate 339. The PWM1 signal drives gate 311 and blocks 312A of the pull-up portion of the high side driver. When PWM1 falls, the node OUTA is yanked up very quickly as described previously. Node 317A, the inversion of PWM1, drives the pull down portion of the high side driver (comprising transistors 351, 319, and 320) and the OUTAPB signal through the path defined by gates 317, 354, 355, 356, 357, and 358. When node 317A falls, then node OUTA is pulled down very quickly through transistor 319 and then held there by transistors 320 and 351. The break-before make-function is provided by sensing the state of OUTAPB and not letting OUTA drive low until a short time period after OUTAPB goes low. In a like manner, the state of OUTA is sensed (sensed indirectly at node 317A because OUTA cannot be sensed directly due to its high voltage) and OUTAP is not allowed to drive high until OUTA has driven high. Inverter 354 and MOS capacitor 359 provide the delay for the low to high transition of OUTAPB. NAND gate 342 and MOS capacitor 343 provide the delay for the high to low transition of OUTA. Note that, in the half bridge case, OUTA drives an external PMOS while OUTAPB drives an external NMOS; therefore, on/off states for the two drivers are opposite. MOS capacitors 344 and 360 are unused options to increase the delay of the break-before-make function, if necessary.

The case when the USER signal is high is called the "push pull case". This case is used for driving wire-wound transformers instead of PZTs. In this case, OUTA again drives a high side PMOS device up to the battery voltage. However OUTAPB and OUTC are both operational, thereby switching at one-half the frequency of the OUTA signal and with a fixed 50% duty cycle. With the USER signal high both gates 334 and 335 pass their input signals (INB and INC) through to their respective output drivers (i.e. drivers 358 and 338).

Figure 4C:
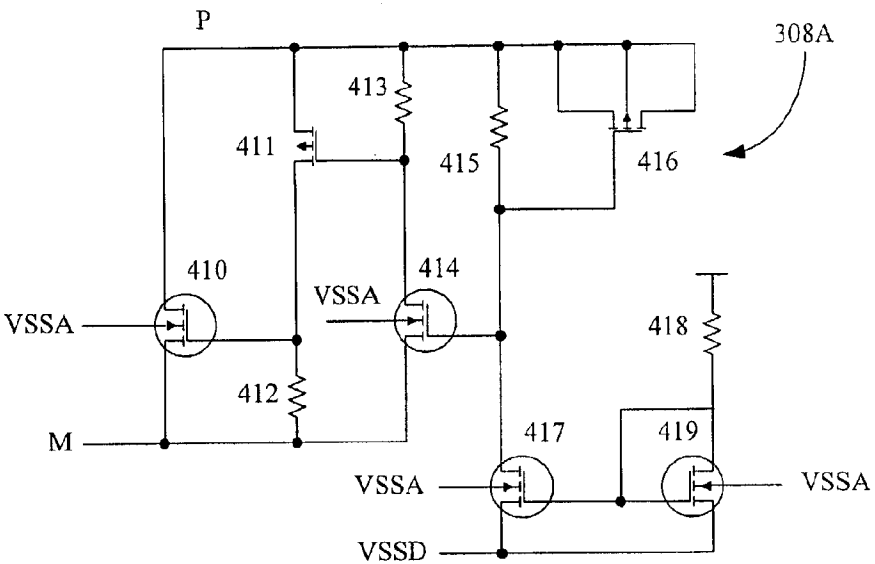
FIG. 4C illustrates yet another embodiment of a clamp having diode characteristics that can be used in the present invention.
Figure 4B:
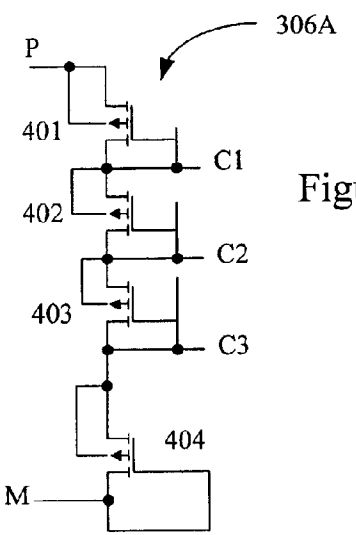
FIG. 4B illustrates another embodiment of a clamp having diode characteristics that can be used in the present invention.
Figure 4A:
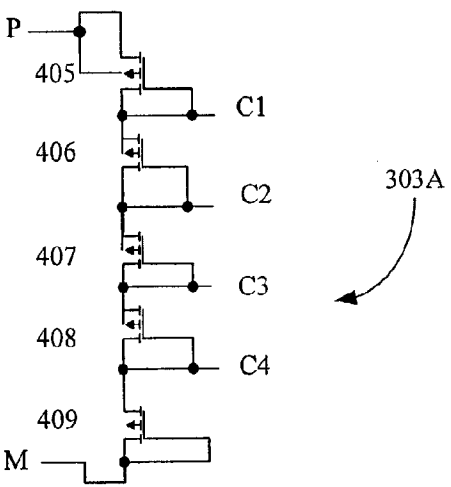
FIG. 4A illustrates one embodiment of a clamp having diode characteristics that can be used in the present invention.

In this embodiment, diodes 303, 306, and 308 (FIG. 3A) are implemented as clamps 303A, 306A, and 308A, respectively. FIGS. 4A, 4B, and 4C illustrate one embodiment of clamps 303A, 306A, and 308A in further detail. For example, in this embodiment, clamp 303A includes five p-type transistors 405-409 serially coupled between nodes p and m, wherein each transistor has its gate connected to its drain and its substrate connected to its source.

FIGS. 4A and 4C use diode-connected PMOS transistors to provide the clamping action. As the source-to-gate voltage of the PMOS transistors exceeds the threshold voltage of the PMOS transistors, current flows through the PMOS devices and increases as the square of the gate-to-source voltage. The increase in current tends to keep the voltage across the diode-connected PMOS string equal to a PMOS threshold voltage times the number of PMOS transistors in the string. (However, note that the voltage is typically larger than that because the PMOS transistors require extra enhancement above the threshold voltage.) Clamp 306A can have a similar configuration and, in this embodiment, includes four p-type transistors serially coupled between nodes p and m, wherein each transistor in clamp 306A has its gate connected to its drain and its substrate connected to its source. Clamp 308A includes a plurality of HVN transistors 410, 414, 417, and 419. Clamp 308A needs to shunt much more current than the other clamps previously described. Specifically, clamp 308A is an active circuit, whereas the other clamps previously described were essentially strings of diodes. In FIG. 4C, resistors 415 and 418 coupled with transistor current mirror 417 and 419 produce a fixed voltage at the gate of transistor 414 that is dependent on the ratio of the resistors and the voltage at the top end of resistor 418 (e.g. 5V). The voltage at the gate of transistor 414 follows the battery voltage at node P. If the voltage at node M drops lower than the voltage at node 414 (plus the threshold voltage of transistor 414), then current flows in transistor 414, thereby causing its drain voltage to drop. This, in turn, causes transistor 411 to turn on, which in turn causes transistor 410 turn on. Transistor 410, normally a large transistor, can provide significant current to node M (essentially preventing node M from dropping any lower in voltage than the gate voltage of transistor 414 plus the threshold voltage of transistor 414). Transistors 414 and 410 must be high voltage devices with n-well extensions on both source and drain because the source-to-body and drain-to-body voltage can both potentially exceed maximum values for a standard NMOS transistor in a normal 5V process. Transistor 417 only requires an n-well extension on the drain side because the source of transistor 417 is at ground. PMOS transistors 411 and 416 never see voltages above the normal operating parameters for PMOS devices in a 5V CMOS process. FIG. 4D illustrates a typical embodiment for S-R latch 337.

Figure 4E:
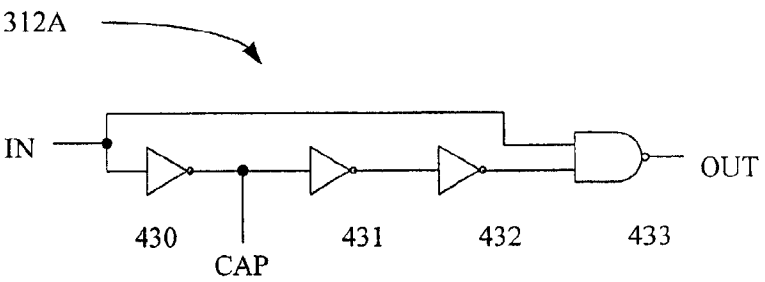
FIG. 4E illustrates one embodiment of a pulse unit that can be used in the output driver of the present invention.

FIG. 4E illustrates one embodiment of pulse unit 312A (as well as pulse unit 318A). Note that pulse unit 312A and inverter 312B in FIG. 3B comprise pulse unit 312 in FIG. 3A (similarly, pulse unit 318A and inverter 318B in FIG. 3D comprise pulse unit 318 in FIG. 3A). In this embodiment, inverters 430, 431, and 432, are serially connected. Note that inverter 430 is very weak to ensure that CAP will charge slowly and provide a meaningful delay. The input signal IN is provided to inverter 430 as well as to a first input terminal of a NAND gate 433. The second input terminal of NAND gate 433 receives the output of inverter 432.

In this configuration, if the IN signal is low, the signal on the first input terminal of NAND gate 433 immediately forces the output signal OUT high. The IN signal, after being delayed and inverted by inverters 430–432, is provided on the second input terminal, but in this case does not change the already high OUT signal. This high output signal, inverted by inverter 312B, ensures that transistor 313 is turned off. On the other hand, if the IN signal transitions high, then both input terminals are providing high signals, thereby generating a low OUT signal. This low output signal, inverted by inverter 312B, turns on transistor 313. However, this low output signal transition high after the now high IN signal propagates through transistors 430–433, thereby turning off transistor 313. Pulse unit 318A and inverter 318B function in a similar manner.

Figure 4F:
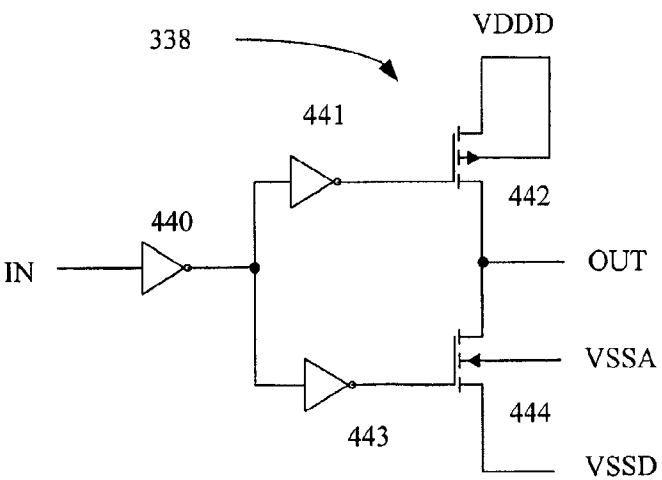
FIG. 4F illustrates one embodiment of a "super" inverter that can be used in the output driver of the present invention.
Figure 4D:
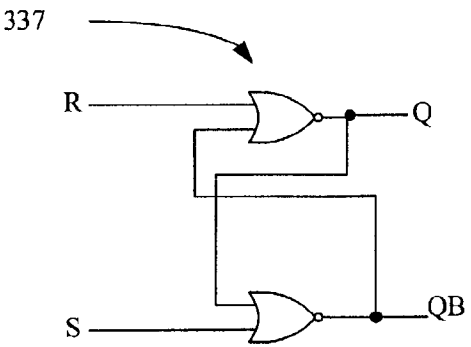
FIG. 4D illustrates an R-S latch that can be used in the output driver of the present invention.

FIG. 4F illustrates one embodiment of inverter 338 (as well as inverter 358). In this embodiment, inverters 440 and 443 invert an input signal IN and provide their output signals to the gates of p-type transistor 442 and n-type transistor 444, respectively. Thus, inverters 440, 441, and 443 in combination with transistors 442 and 444 function as an inverter whose large output devices, i.e. transistors 442 and 444, do not simultaneously conduct. This type of inverter driver, also called a "super" inverter, is useful because large fault current will not flow from power to ground during switching of transistors 442 and 444. This break-before-make action is accomplished by sizing inverter 441 so that its output falls slowly, but rises quickly. In a similar manner, inverter 443 is sized so that its output falls quickly, but rises slowly. In this way, transistors 442 and 444 are never conducting at the same time.

Table 1 lists the transistor widths and lengths of various components in output driver 201. Note that these widths and lengths are illustrative only and not limiting. Other embodiments of the present invention can have components with other values.

TABLE 1

| Component Reference Numeral | Transistor Values: N-type Transistor Width (u) | N-type Transistor Length (u) | P-type Transistor Width (u) | P-type Transistor Length (u) |
|---|---|---|---|---|
| 301/302 | | | 20 | 4 |
| 307 | | | 50 | 1 |
| 310 | 52 | 3.3 | | |
| 311 | 112 | 3.1 | | |
| 312B | 10 | 0.8 | 20 | 0.8 |
| 313 | 62 | 3.3 | | |
| 317 | 2 | 0.8 | 4 | 0.8 |
| 318B | 100 | 0.8 | 200 | 0.8 |
| 319 | 110 | 3.1 | | |
| 320 | 112 | 3.1 | | |
| 322/323 | 10 | 10 | | |
| 325/326 | 26 | 10 | | |
| 330 | 2 | 0.8 | 4 | 0.8 |
| 331 | 2 | 0.8 | 8 | 0.8 |
| 332/333/334/335/336 | 2 | 0.8 | 2 | 0.8 |
| 338 | | | | |
| 339 | 2 | 0.8 | 2 | 0.8 |
| 340 | 2 | 0.8 | 4 | 0.8 |
| 341 | 10 | 0.8 | 20 | 0.8 |
| 342 | 4 | 1 | 40 | 10 |
| 343/344 | 26 | 10 | | |
| 351 | 10 | 1.5 | | |
| 352/353 | 26 | 10 | | |
| 354 | 4 | 1 | 4 | 10 |
| 355 | 10 | 0.8 | 20 | 0.8 |
| 356 | 2 | 0.8 | 2 | 0.8 |

TABLE 1-continued

| Component Reference Numeral | Transistor Values: N-type Transistor Width (u) | N-type Transistor Length (u) | P-type Transistor Width (u) | P-type Transistor Length (u) |
|---|---|---|---|---|
| 357 | 2 | 0.8 | 4 | 0.8 |
| 359/360 | 26 | 10 | | |
| 401/402/403/404 | | | 40 | 0.8 |
| 405/406/407/408/409 | | | 10 | 0.8 |
| 410/414 | 106 | 4.3 | | |
| 411/416 | | | 100 | 0.8 |
| 417/419 | 242 | 5.1 | | |
| 430 | 2 | 15 | 4 | 15 |
| 431 | 2 | 2 | 4 | 2 |
| 432 | 2 | 0.8 | 4 | 0.8 |
| 433/440 | 10 | 0.8 | 20 | 0.8 |
| 441 | 30 | 0.8 | 150 | 0.8 |
| 442 | | | 50 | 0.8 |
| 443 | 150 | 0.8 | 50 | 0.8 |
| 444 | 50 | 0.8 | | |

Table 2 provides illustrative values for the resistors shown in FIGS. 3A and 4C. Note that resistors in other embodiments of the present invention can have different values depending on the values of other components in the system.

TABLE 2

| Component Reference Numeral | Resistor Values: Resistance (Ohm) | Length (u) | Width (u) |
|---|---|---|---|
| 305 | 10 k | 166 | 10 |
| 412 | 250 | 21 | 5 |
| 413 | 1200 | 100 | 5 |
| 415 | 50 k | 833 | 1 |
| 418 | 40 k | 667 | 1 |

Various embodiments of the present invention have been described herein. Those skilled in the art will recognize various component replacements or modifications that can be made to those embodiments. Therefore, the scope of the present invention is only limited by the appended claims.

What is claimed is:

1. A method of powering a cold cathode fluorescent light (CCFL) circuit, the method including:

determining a frequency provided to power the CCFL circuit such that a duty cycle of a driving waveform to the CCFL circuit is forced to a predetermined value, wherein determining the frequency includes:

generating a first signal functionally related to the duty cycle of the driving waveform;

generating a second signal functionally related to the current of the CCFL circuit; and using the first signal and the second signal to determine the frequency of the driving waveform.

2. The method of claim 1, wherein the duty cycle of the driving waveform is approximately 50%.

3. The method of claim 2, wherein generating the first signal includes sensing a voltage of the driving waveform at a first node.

4. The method of claim 3, wherein generating the first signal further includes setting values of a plurality of resistors for sensing the voltage of the driving waveform.

5. The method of claim 4, wherein setting values is dependent on the predetermined value of the duty cycle.

6. The method of claim 4, wherein setting values as dependent on a high level of the driving waveform.

7. The method of claim 4, wherein setting values is dependent on a set reference voltage.

8. The method of claim 3, wherein generating the first signal includes generating a first DC signal that is functionally related to a time-averaged voltage at the first node.

9. A method of powering a cold cathode fluorescent light (CCFL) circuit, the method including:

determining a frequency provided to power the CCFL circuit based on a duty cycle of a driving waveform to the CCFL circuit, wherein the duty cycle is approximately 50%, wherein determining the frequency includes:

sensing a voltage of the driving waveform at a first node;

generating a first DC signal that is functionally related to a time-averaged voltage at the first node;

sensing a voltage at a second node that is proportional to a CCFL current; and generating a second DC signal that is proportional to a time-averaged voltage at the second nodes wherein the first DC signal and the second DC signal are used in determining the frequency.

10. The method of claim 9, further including clamping the second DC signal.

11. The method of claim 10, further including clamping the first DC signal.

12. The method of claim 11, wherein clamping the first DC signal includes selecting one of a plurality of current sources.

13. The method of claim 12, further including generating an interrupt signal that controls the driving waveform.

14. A method for controlling a voltage increase on a line in a CCFL circuit, the method including:

limiting the voltage increase to a first predetermined amount based on a first current source and a capacitor; and selectively resetting a capacitance of the capacitor to zero at the beginning of every dimming cycle of the CCFL circuit, thereby providing a soft start on the line.

15. A method for controlling a voltage increase on a line, the method including:

limiting the voltage increase to a first predetermined amount based on a first current source and a capacitor;

selectively resetting a capacitance of the capacitor to zero to provide a soft start on the line; and switching to a second current source, thereby limiting the voltage increase to a second predetermined amount based on the second current source and the capacitor.

16. A method for providing a drive signal to a CCFL circuit, the method comprising:

generating a first pulsed signal for pulling the drive signal up to a first predetermined value during a first transition of an input signal to the driver;

using a first current source to maintain the first predetermined value during a first state of the input signal;

generating a second pulse for pulling the drive signal down to a second predetermined value during a second transition of the input signal; and using a second current source circuit to maintain the second predetermined value during a second state of the input signal.

17. The method of claim 16, further including limiting the second predetermined value by using a device with diode characteristics.

* * * * *